US006492768B1

(12) United States Patent
Koizumi et al.

(10) Patent No.: US 6,492,768 B1
(45) Date of Patent: Dec. 10, 2002

(54) CATHODE RAY TUBE HAVING AN IMPROVED INDIRECTLY HEATED CATHODE

(75) Inventors: Sachio Koizumi, Mobara (JP); Norio Iwamura, Chousei-gun (JP); Terutoshi Ichihara, Isumi-gun (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

(21) Appl. No.: 09/325,573

(22) Filed: Jun. 4, 1999

(30) Foreign Application Priority Data

Jun. 5, 1998 (JP) ..... 10-157729

(51) Int. Cl.[7] ..... H01J 29/46

(52) U.S. Cl. ..... 313/446; 313/337; 313/341; 313/343; 313/344

(58) Field of Search ..... 313/337, 341, 313/343, 344, 446

(56) References Cited

U.S. PATENT DOCUMENTS

| | | | | |
|---|---|---|---|---|
| 4,149,104 A | | 4/1979 | Yoshimori | |
| 4,611,146 A | | 9/1986 | Morrison | |
| 6,191,528 B1 | * | 2/2001 | Iwamura et al. | 313/446 |
| 6,335,590 B2 | * | 1/2002 | Iwamura et al. | 313/446 |

FOREIGN PATENT DOCUMENTS

| | | |
|---|---|---|
| JP | 2-160332 | 6/1990 |
| JP | 3-84827 | 4/1991 |
| JP | 4-292830 | 10/1992 |
| JP | 6-21145 | 3/1994 |
| JP | 7-254352 | 10/1995 |
| KR | 1989-0002946 | 4/1989 |
| WO | 97/22131 | 6/1997 |

* cited by examiner

*Primary Examiner*—Michael H. Day
*Assistant Examiner*—Glenn Zimmerman
(74) *Attorney, Agent, or Firm*—Antonelli, Terry, Stout & Kraus, LLP

(57) ABSTRACT

A cathode ray tube includes a phosphor screen and an electron gun. The electron gun includes an indirectly heated cathode structure and plural grid electrodes in axially spaced relationship. The cathode structure includes a base metal having an electron emissive material coating and a heater for heating the base metal. The heater includes a major heating portion having a spirally wound heating wire and leg portions disposed at ends of the major heating portion, and each of the leg portions includes a first multilayer winding portion having heating wires wound spirally in plural layers and a second multilayer winding portion disposed intermediate between the major heating portion and the first multilayer winding portion and having heating wires wound in plural layers. The major heating portion and at least a portion of the second multilayer winding portion are covered with an insulating coating, the heater is welded to electrical conductors for applying a voltage thereto at the first multilayer winding portion, and the number of layers in the second multilayer winding portion is at least three and the number of layers in the first multilayer winding portion is larger than that in the second multilayer winding portion.

7 Claims, 10 Drawing Sheets

CATHODE RAY TUBE HAVING AN IMPROVED INDIRECTLY HEATED CATHODE

BACKGROUND OF THE INVENTION

The present invention relates to a cathode ray tube having an electron gun employing an indirectly heated cathode, and particularly to a cathode ray tube having a heater for the indirectly heated cathode with ease of its welding and its reliability improved.

Cathode ray tubes such as TV picture tubes and display tubes are widely used as a display means in various kinds of information processing equipment because of their capability of high-resolution image reproduction.

The cathode ray tubes of this kind include an evacuated envelope comprising a panel portion having a phosphor screen formed of phosphors coated on its inner surface, a tubular neck portion and a funnel portion for connecting the panel portion and the neck portion, an electron gun housed in the tubular neck portion comprising an electron beam generating section including an indirectly heated cathode, a control electrode and an accelerating electrode, and a main lens section for focusing an electron beam generated in the electron beam generating section onto the phosphor screen, and a deflection yoke mounted around the funnel portion for scanning the phosphor screen with the electron beam from the electron gun.

FIG. 5 is a schematic cross-sectional view of a shadow mask type color cathode ray tube for explaining an example of a structure of a cathode ray tube. Reference numeral 1 denotes a panel portion, 2 is a funnel portion, 3 is a neck portion, 4 is a phosphor screen formed of phosphors coated on the inner surface of the panel portion, 5 is a shadow mask serving as a color selection electrode, 6 is a magnetic shield for shielding an external magnetic field (the Earth's magnetic field) for preventing the Earth's magnetic field from having adverse influences on the trajectory of electron beams. Reference numeral 7 denotes a deflection yoke, 8 is external magnets for beam adjustment, 9 is an electron gun provided with indirectly-heated cathodes for emitting three electron beams and 10 are the three electron beams only one of which is shown.

The three electron beams 10 from the electron gun 9 are modulated by video signals from an external signal processing circuit (not shown), respectively, and are projected toward the phosphor screen 4. The electron beams 10 scan the phosphor screen 4 two-dimensionally by being subjected to the horizontal and vertical deflection magnetic fields generated by the deflection yoke 7 mounted around the transition region between the neck portion 3 and the funnel portion 2. The shadow mask 5 reproduces a desired image by passing the three electron beams through a large number of apertures therein to the phosphor screen such that each beam impinges upon and excites only one of the three kinds of color phosphor elements in the phosphor screen.

FIG. 6 is a side elevation view of an electron gun for explaining an example of a structure of an electron gun used for the color cathode ray tube shown in FIG. 5. The electron gun comprises a control electrode (the first grid electrode or G1) 11, an accelerating electrode (the second grid electrode or G2) 12, focus electrodes (the third grid electrode or G3, the fourth grid electrode or G4, and the fifth grid electrode or G5) 13, 14, 15, an anode (the sixth grid electrode or G6) 16, and a shield cup 17 physically retained in axial predetermined spaced relationship in the order named by multiform glass 20, and the respective electrodes are electrically connected to respective stem pins 18a implanted in a stem 18 by welding a tab or a lead provided to the electrodes, to the stem pins 18*a*.

In this electron gun, an indirectly heated cathode structure 21 is spaced closely from the electron beam apertures in the control electrode 11 toward the stem 18, and has heaters for heating the electron-emissive surfaces.

Reference numeral 19 denote bulb spacer contacts for centering the central longitudinal axis of the electron gun coincident with the axis of the neck portion by pressing resiliently against the inner wall of the neck portion and for effecting delivery of an anode voltage from the internal conductive coating coated on the inner walls of the funnel and neck portions to the electron gun.

The indirectly heated cathodes 21, the control grid 11 and the accelerating electrode 12 form an electron beam generating section (a triode portion). The focus electrodes 13 to 15 accelerate and focus the electron beams emitted from the electron beam generating section, and then a main lens formed between the focus electrode 15 and the anode 16 focuses the electron beams onto the phosphor screen.

The stem 18 is fused to close the open end of the neck portion 3 of the vacuum envelope, and signals and voltages from external circuits are applied to the respective electrodes via the stem pins 18. The external magnets 8 (the magnet assembly) for beam adjustment shown in FIG. 1 correct errors in landing of the electron beams on the phosphor elements caused by a misalignment in axis or a rotational error between the electron gun and the panel portion, the funnel portion and the shadow mask.

FIG. 7 is a cross-sectional view of the indirectly heated cathode structure 21 shown in FIG. 6. The indirectly heated cathode structure 21 comprises bead supports 22, an eyelet 23, heater supports 24, a heater 25, a base metal 27 for supporting an electron-emissive material 26, a cathode support sleeve 28 and a cathode cylinder 29.

The indirectly heated cathode structure 21 is fixed on multiform glass 20 by the eyelet 23 and the bead supports 22. The heater 25 housed within the cathode support sleeve 28 are fixed by welding its ends to the heater support 24.

FIGS. 8A and 8B are illustrations of a structure of the heater, FIG. 8A being a side view of the heater and FIG. 8B being an enlarged fragmentary cross-sectional view of the encircled portion designated "A" in FIG. 8A. As shown in FIG. 8B, the heater 25 comprises a tungsten wire 31 spirally wound, an alumina insulating layer 32 coated around the tungsten wire 31, and a blackened fine-powder tungsten layer 33 coated around the alumina insulating layer 32. The blackened layer 33 is intended for lowering the temperature required of the heater 25 by improving the heat radiation from the heater 25, and consequently improving the reliability of the heater.

In FIG. 8A, reference character HL denote a leg portion of the heater 25 comprised of tungsten wires spirally wound in three layers, HM is a major heating portion of the heater 25 formed by winding spirally in a large diameter a tungsten coiled wire having been wound initially spirally in a small diameter (hereinafter referred to merely as a coiled coil portion), HA is a portion coated with alumina, HB is a blackened portion covered with the blackened fine-powder tungsten layer 33, HE is a portion not covered with alumina and reference numeral 39 denotes a hollow formed after dissolving and removing a molybdenum mandrel.

A method of forming the leg portion HL of the heater 25 in the three layers of tungsten wires is disclosed in Japanese Utility Model Publication No. Sho 57-34671 (Japanese utility model application No. Sho 51-167255, laid-open date: Jul. 12, 1978, Publication date: Jul. 30, 1982).

FIGS. 9A–9E illustrate sequence of steps in a conventional method of fabricating the conventional heater.

In FIG. 9A, a tungsten wire 31 is wound spirally forward as indicated by an arrow P around a molybdenum mandrel wire 40 up to point A.

Next, as illustrated in FIG. 9B, the tungsten wire 31 is wound spirally backward from point A to point B as indicated by an arrow Q.

Then, as illustrated in FIG. 9C, the tungsten wire 31 is wound spirally forward again from point B to point C over a centerline CL for bending in a subsequent process as indicated by an arrow R, forming a three-layer winding portion TWA ranging from point A to point B.

Next, as illustrated in FIG. 9D, the tungsten wire 31 is wound spirally backward from point C to point D as indicated by an arrow S.

Next, as illustrated in FIG. 9E, the tungsten wire 31 is wound spirally forward from point D to point E as indicated by an arrow T, forming a three-layer winding portion TWB ranging from point C to point D.

The tungsten wire thus wound around the molybdenum mandrel wire 40 is cut at the respective centers F, G of the three-layer winding portions TWA and TWB to provide a tungsten wire winding having a length HQL for one heater with the leg portions THLA, THLB of three-layer winding and is formed into a final shape by folding at the centerline CL as shown in FIG. 8A. Then, the molybdenum mandrel wire 40 is dissolved with acid, leaving a hollow 39 as shown in FIG. 8B.

The heater having the leg portions of the above three-layer winding structure provides the following advantages:

(i) prevention of breaks of a tungsten wire by sparks within a cathode ray tube, (ii) reduction of power consumption by concentration of heat generation in a coiled coil portion 35 due to low resistance of the three-layer winding portions, (iii) improvement in workability in the operation of welding a heater, (iv) suppression of heat generation in the portion not covered with alumina caused by an overcurrent upon power turn on.

The tungsten wire for heaters are very thin, and are usually 30 $\mu$m to 50 $\mu$m in diameter. The structure of the wound thin wires is very weak in mechanical strength, and welding of heaters to a heater support requires a great deal of skill. The three-layer winding structure improves workability in welding heaters, and suppresses occurrences of breaks of heaters by sparks or overcurrents upon power turn on.

Recently it has been difficult to perform operations requiring skill such as welding of heaters. Although the above prior art has improved the workability in welding of heaters, sufficient consideration has never been given to a following problem in heater welding by unskilled workers or by machines, that is, the mechanical strength of the leg portions wound in three layers of heaters is not sufficient for the operation of manually inserting a heater into a cathode support sleeve or for the automatic operation of detecting weld positions of a heater and then welding the heater.

Cracks sometimes occur in the alumina-coated portion in the vicinity of weld points in the operation of welding the portion not covered with alumina, of the leg portions wound in three layers to a heater support. For prevention of the cracks, rigidity of the three-layer winding portion needs to be reduced by winding the tungsten wires at a coarser pitch in that portion, but a problem arises that the workability in welding deteriorates.

SUMMARY OF THE INVENTION

It is an object of the present invention to provide a cathode ray tube having an electron gun employing an indirectly heated cathode structure free from cracks in the alumina insulating layer of leg portions of the heater without deterioration in welding workability by solving the above problems with the prior art.

To accomplish the above object, according to a preferred embodiment of the present invention, there is provided a cathode ray tube comprising an evacuated envelope comprising a panel portion, a neck portion, a funnel portion for connecting the panel portion and the neck portion and a stem having a plurality of pins therethrough and being sealed to close the neck portion at one end thereof, a phosphor screen formed on an inner surface of the panel portion, an electron gun housed in the neck portion, the electron gun comprising an electron beam generating section comprising an indirectly heated cathode structure, a control electrode and an accelerating electrode, and a main lens for focusing an electron beam from the electron beam generating section onto the phosphor screen, and a deflection yoke mounted around a vicinity of a transitional region between the neck portion and the funnel portion for scanning the electron beam on the phosphor screen, the indirectly heated cathode structure comprising a metal sleeve, a base metal having an electron emissive material coating on an outer top surface thereof and attached to one end of the metal sleeve, and a heater positioned within the metal sleeve, wherein the heater comprises a major heating portion having a spirally wound heating wire and leg portions disposed at ends of the major heating portion, each of the leg portions comprises a first multilayer winding portion having heating wires wound spirally in a plurality of layers and a second multilayer winding portion disposed intermediate between the major heating portion and the first multilayer winding portion and having heating wires wound in a plurality of layers, the major heating portion and at least a portion of the second multilayer winding portion are covered with an insulating coating, the heater is welded to electrical conductors for applying a voltage thereto at the first multilayer winding portion, and layers in the second multilayer winding portion is at least three in number and layers of the first multilayer winding portion is larger in number than layers in the second multilayer winding portion.

The present invention is not limited to the above structure, and various changes and modifications may be made without departing from the scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail hereunder with reference to the accompanying drawings.

Figure 1:
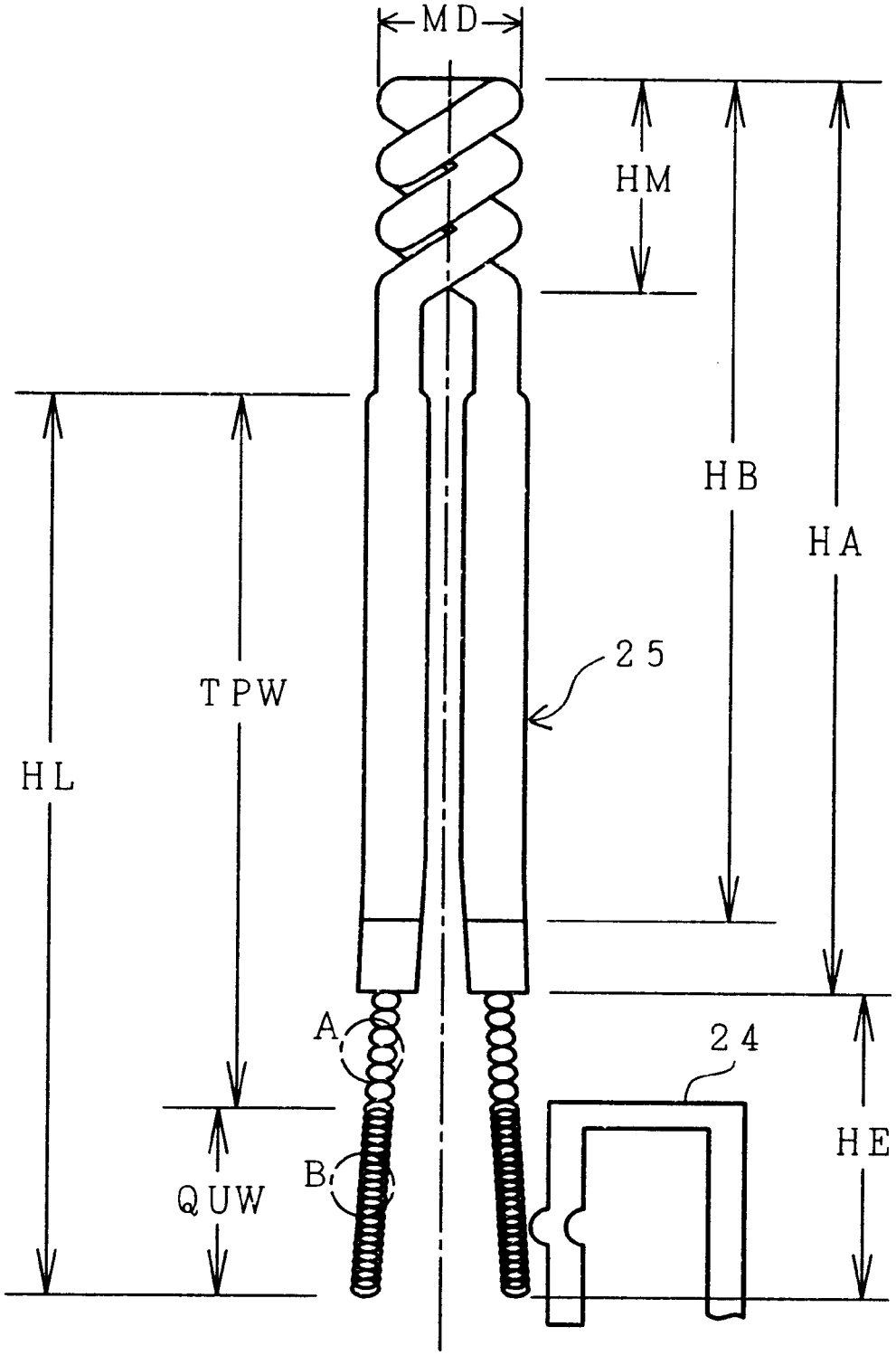
FIG. 1 is a side elevation view of an external view of a heater for use with an indirectly heated cathode structure for explaining an embodiment of a cathode ray tube of the present invention.
Figure 8A:
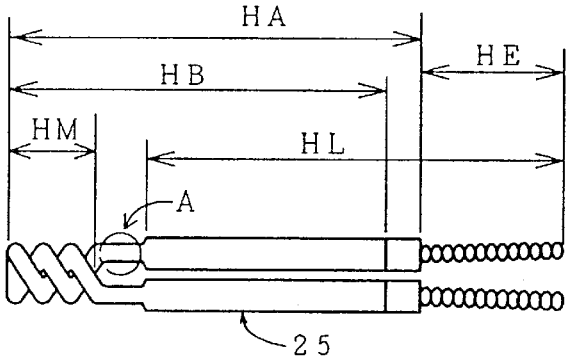
FIG. 8A (PRIOR ART)
FIGS. 8A and 8B are illustrations of a structure of a conventional heater, FIG. 8A being a side view of the heater and FIG. 8B being an enlarged fragmentary view of the encircled portion designated "A" in FIG. 8A.
Figure 8B:
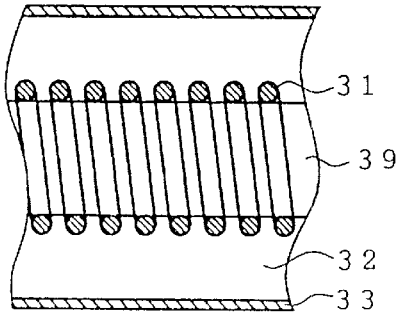
FIG. 8B (PRIOR ART)
Figures 9A, 9B, 9C, 9D, 9E:
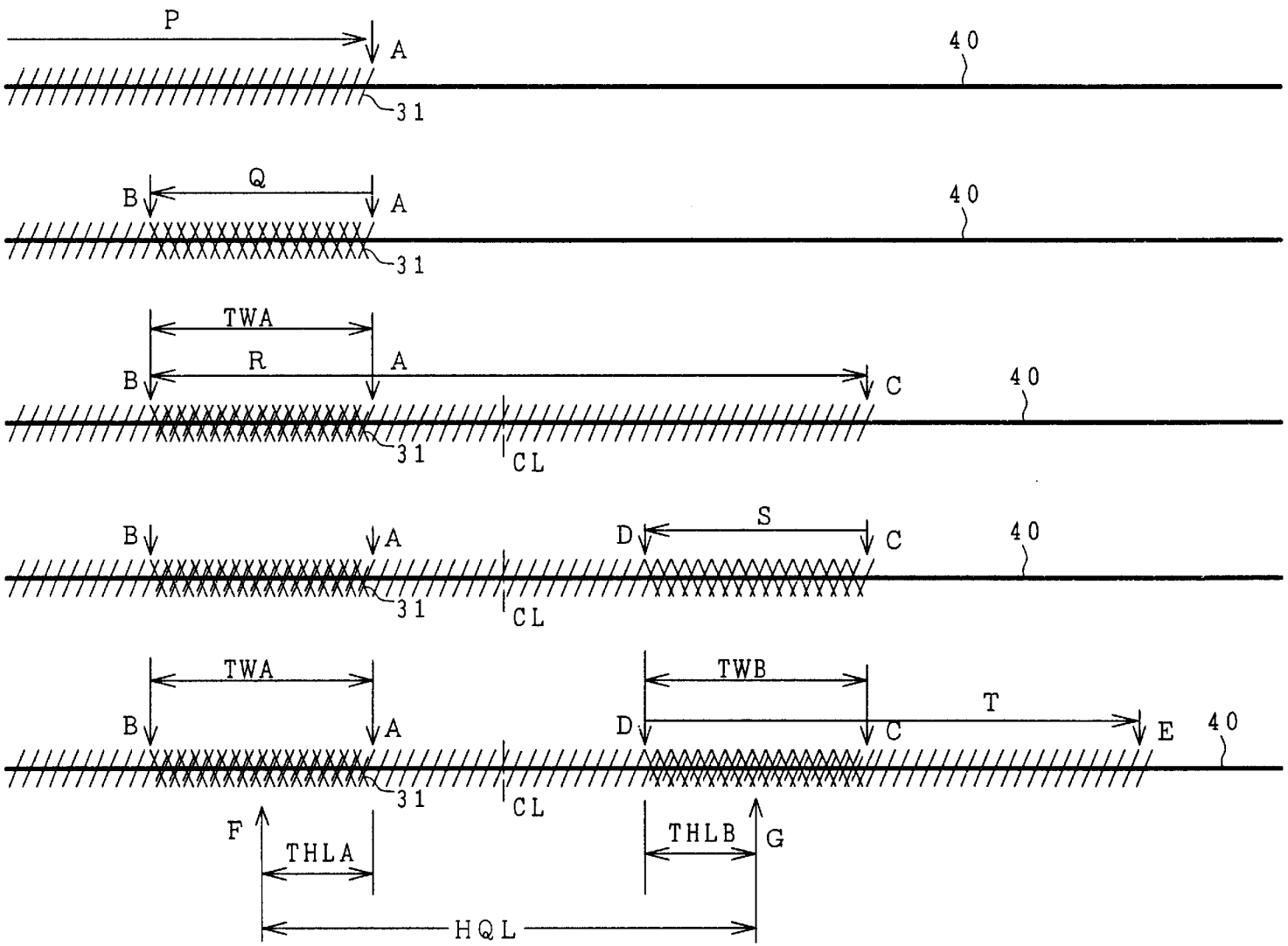
FIG. 9A (PRIOR ART)
FIG. 9B (PRIOR ART)
FIG. 9C (PRIOR ART)
FIG. 9D (PRIOR ART)
FIG. 9E (PRIOR ART)
FIGS. 9A–9E illustrate sequence of steps in a conventional method of fabricating the conventional heater.

FIG. 1 is an external side view of view of a heater for use with an indirectly heated cathode structure for explaining an embodiment of a cathode ray tube of the present invention. The basic structure of the heater 25 is similar to the prior art heater explained in connection with FIG. 8. The tungsten wires are wound spirally, are coated with alumina, and then fine-powder tungsten is coated on the surface of the alumina insulating film, and then is blackened.

In FIG. 1, a leg portion HL comprises a three-layer winding portion TPW comprised of tungsten wires wound spirally in three layers and a five-layer winding portion QUW comprised of tungsten wires wound spirally in five layers, reference character HM denotes a coiled coil portion (a major heating portion), HB is a portion blackened with fine tungsten powders, HA is a portion covered with alumina, and HE is a portion not covered with alumina. Reference 24 is a heater support to which the heater is welded.

The leg portion HL comprises the three-layer winding portion TPW and the five-layer winding portion QUW, the five-layer winding portion QUW is welded to the heater support 24. Only one of two heater supports 24 to be welded to the respective legs of the heater 25 is shown in FIG. 1.

Dimensional examples for the structure in FIG. 1 are:

the diameter of the major heating portion, MD=1.4 mm, the height of the major heating portion, HM=2.0 mm, the length of the portion covered with alumina, HA=9.0 mm, the length of the exposed portion, HE=3.5 mm, the length of the three-layer winding portion, TPW=7.8 mm, and the length of the five layer winding portion, QUW=1.5 mm.

Figure 2:
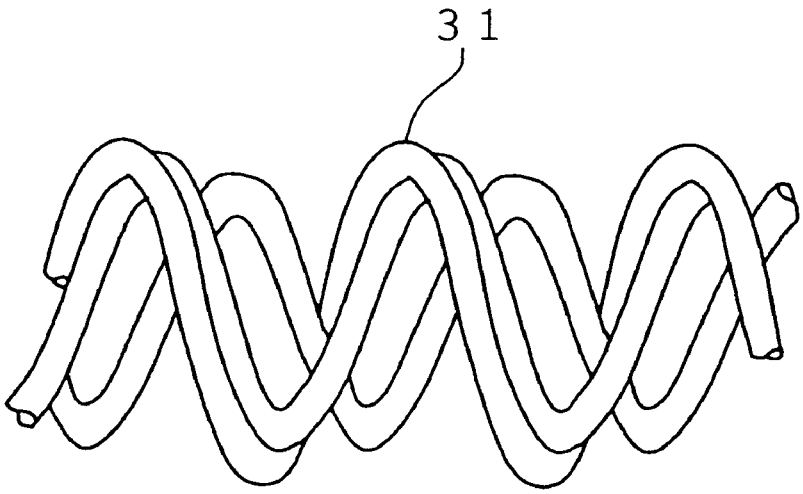
FIG. 2 is an enlarged fragmentary side view of the three-layer winding portion TPW of the leg portion of the heater of FIG. 1.
Figure 3:
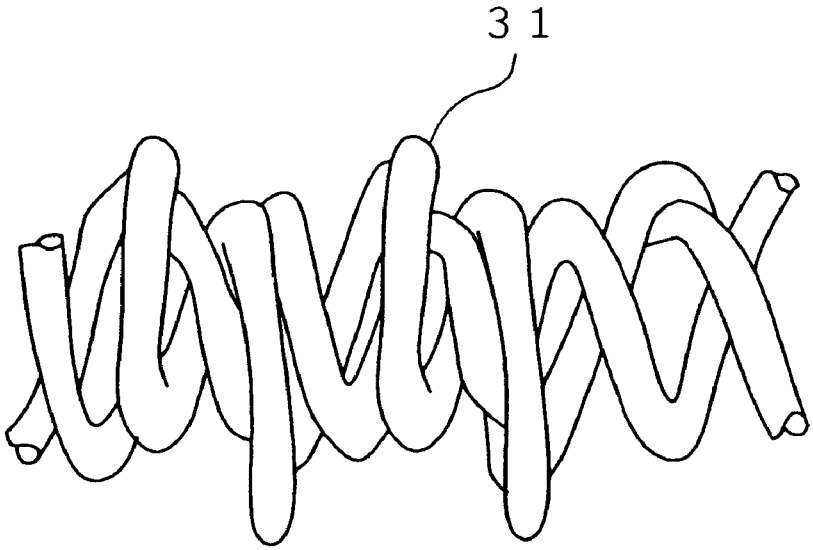
FIG. 3 is an enlarged fragmentary side view of the five-layer winding portion QUW of the leg portion of the heater of FIG. 1.

FIG. 2 is an enlarged fragmentary side view of a portion A of the three-layer winding leg portion TPW of FIG. 1, and FIG. 3 is an enlarged fragmentary side view of a portion B of the five-layer winding leg portion QUW of FIG. 1. As shown in FIG. 1, a major portion of the leg portion HL comprises tungsten wires wound spirally in three layers, and consequently the rigidity of the major portion of the leg portion is reduced compared with the portion to be welded, and cracks are prevented from occurring in the alumina insulating layer.

The five-layer winding structure at portions welded to the heater supports 24 provides dense winding density as shown in FIG. 3, and consequently increases the rigidity of the portions and improves workability greatly in the heater welding operation.

FIGS. 4A–4I illustrate sequence of steps in a method of fabricating continuously the heater shown in FIG. 1, centering on the leg portions of the heater.

Figure 4A:
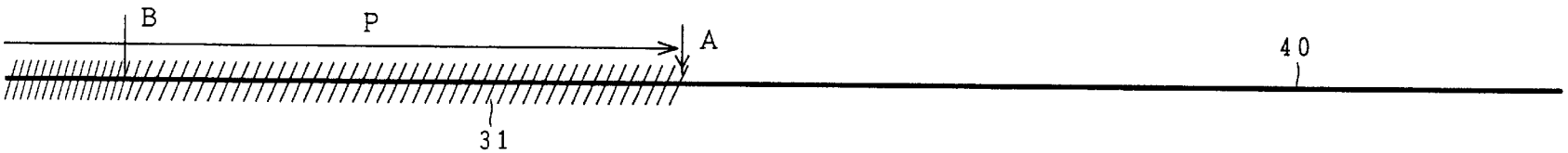
FIGS. 4A–4I illustrate sequence of steps in a method of fabricating the heater shown in FIG. 1.

Initially, in FIG. 4A, a tungsten wire 31 of 0.032 mm in diameter is wound spirally forward as indicated by an arrow P around a molybdenum mandrel wire 40 of 0.150 mm in diameter up to point A. The tungsten wire 31 is wound spirally at a winding pitch for the major heating portion HM (see FIG. 1), 150 turns per cm, for example, to point B which corresponds to a starting point of the three-layer winding portion TPW of one of the two heater leg portions HL (see FIG. 1) and then the tungsten wire 31 is spirally wound at a winding pitch of 30 turns per cm, for example, from point B to point A.

Figure 4B:
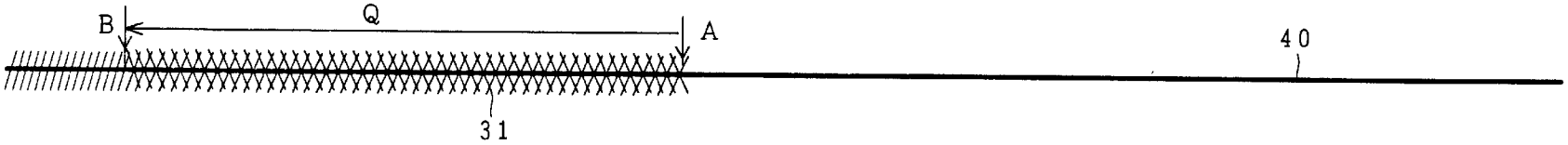

Next, as illustrated in FIG. 4B, the tungsten wire 31 is wound spirally at a winding pitch of 50 turns per cm, for example, backward from point A to point B as indicated by an arrow Q.

Figure 4C:
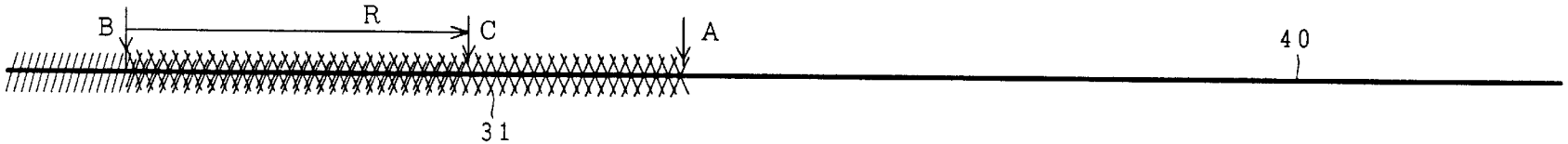

Then, as illustrated in FIG. 4C, the tungsten wire 31 is wound spirally forward again at a winding pitch of 30 turns per cm, for example, from point B to point C as indicated by an arrow R.

Figure 4D:
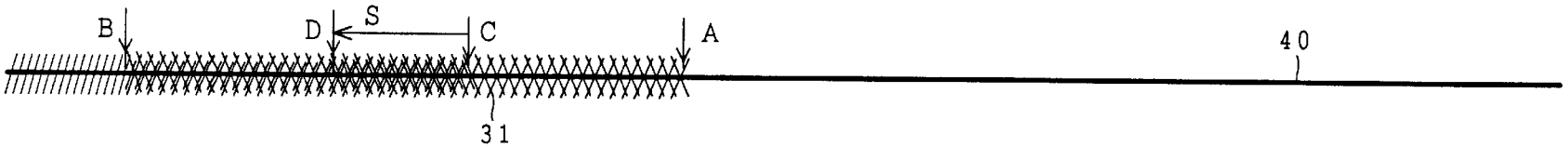

Next, as illustrated in FIG. 4D, the tungsten wire 31 is wound spirally backward at a winding pitch of 30 turns per cm, for example, from point C to point D as indicated by an arrow S.

Figure 4E:
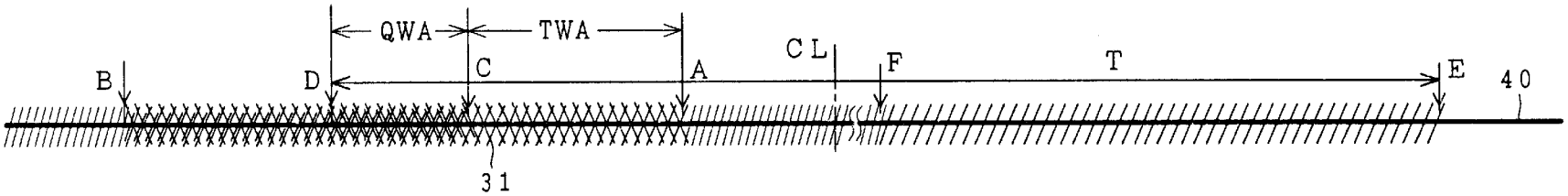

Then, as illustrated in FIG. 4E, the tungsten wire 31 is wound spirally forward again from point D to point E over a centerline CL for bending in a subsequent process, as indicated by an arrow T. The tungsten wire 31 is initially wound spirally at the winding pitch for the major heating portion HM, 150 turns per cm, to point C, and then is wound spirally at the winding pitch of 30 turns per cm from point C to point A which corresponds to a starting point of major heating portion HM, and then is wound spirally wound at the winding pitch of 150 turns per cm from point A to point F which corresponds to a starting point of the three-layer winding portion TPW of the other of the two heater leg portions HL and then the tungsten wire 31 is spirally wound at the winding pitch of 30 turns per cm from point F to point E. A five-layer winding portion QWA is formed ranging from point C to point D, and a three-layer winding portion TWA is formed ranging from point C to point A.

Figure 4F:
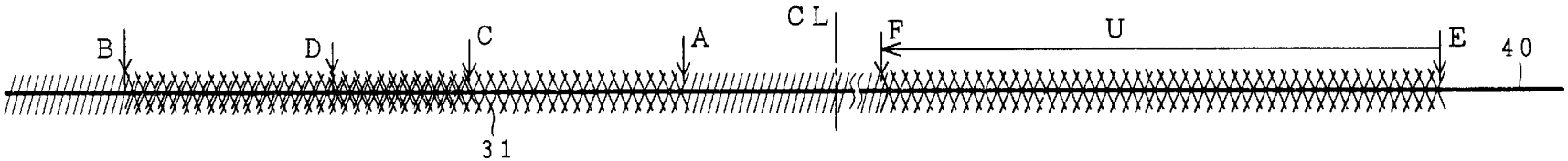

Next, as illustrated in FIG. 4F, the tungsten wire 31 is wound spirally backward at the winding pitch of 50 turns per cm from point E to point F as indicated by an arrow U.

Figure 4G:
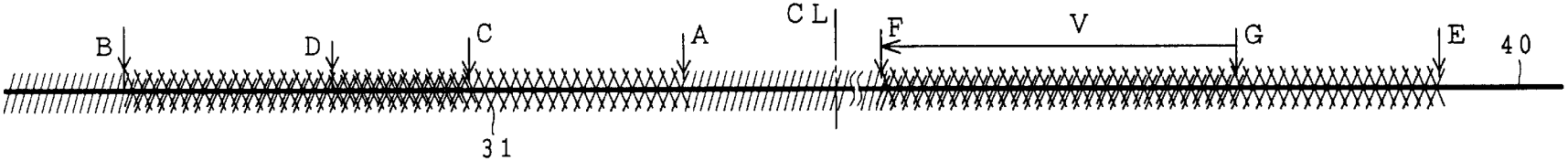

Next, as illustrated in FIG. 4G, the tungsten wire 31 is wound spirally forward at the winding pitch of 30 turns per cm from point F to point G as indicated by an arrow V.

Figure 4H:
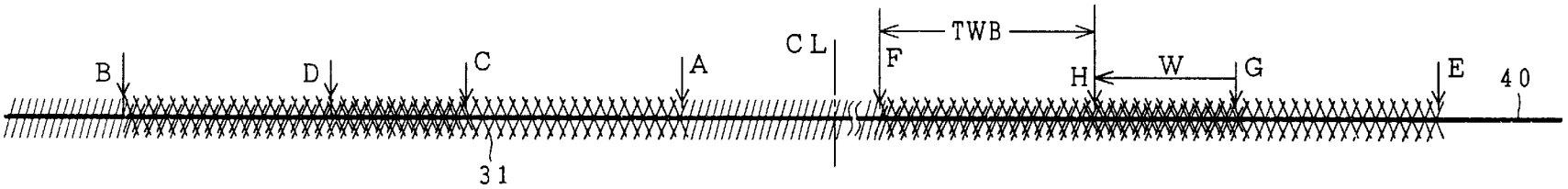

Next, as illustrated in FIG. 4H, the tungsten wire 31 is wound spirally backward at the winding pitch of 30 turns per cm from point G to point H as indicated by an arrow W.

Figure 4I:
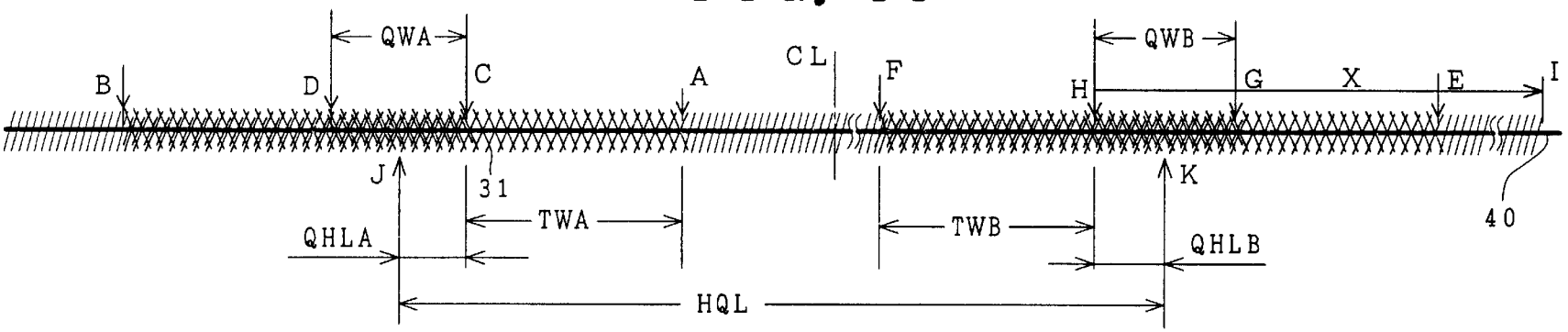
Figure 5:
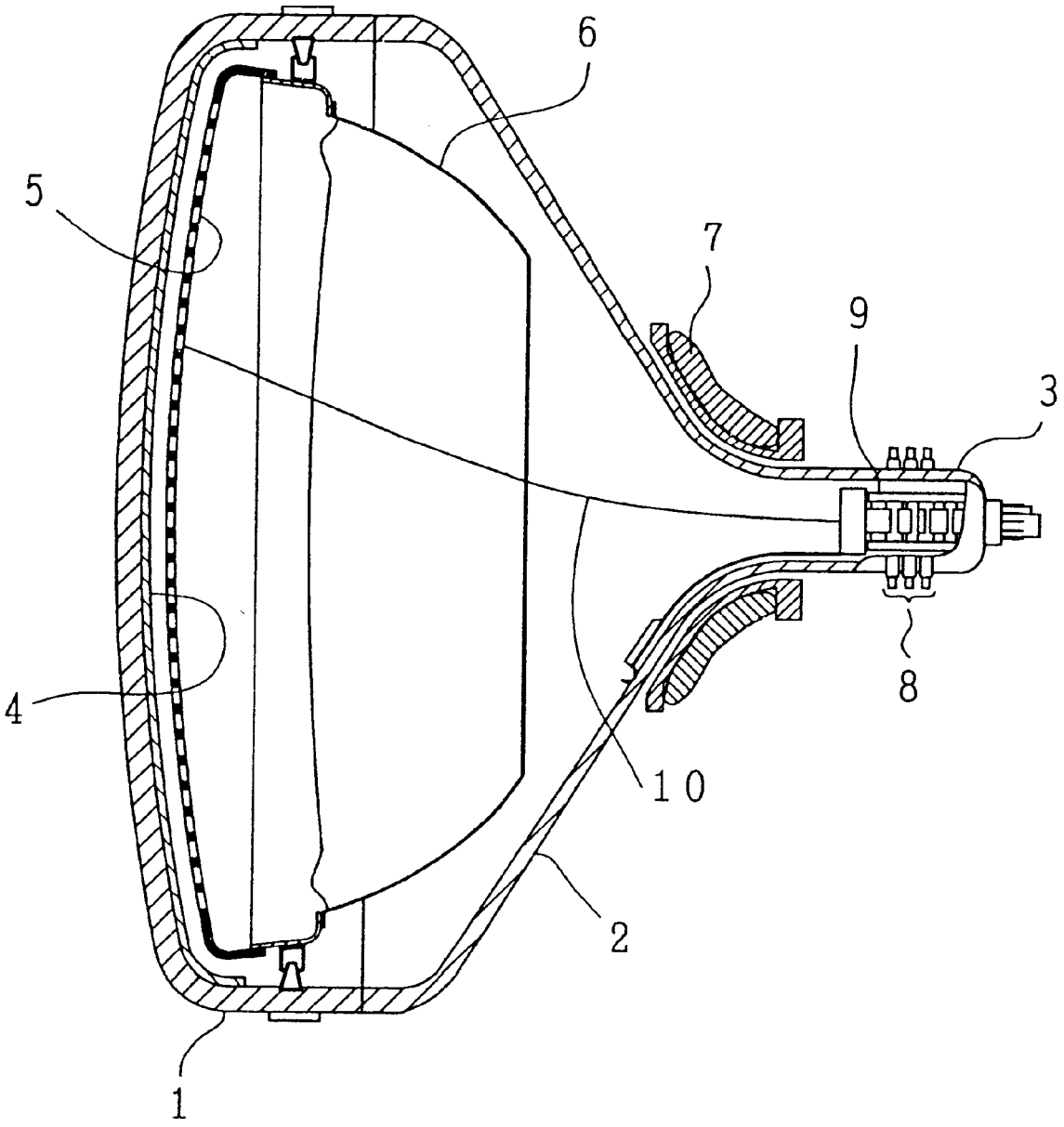
FIG. 5 (PRIOR ART)
FIG. 5 is a schematic cross-sectional view of a shadow mask type color cathode ray tube for explaining an example of a structure of a cathode ray tube.
Figure 6:
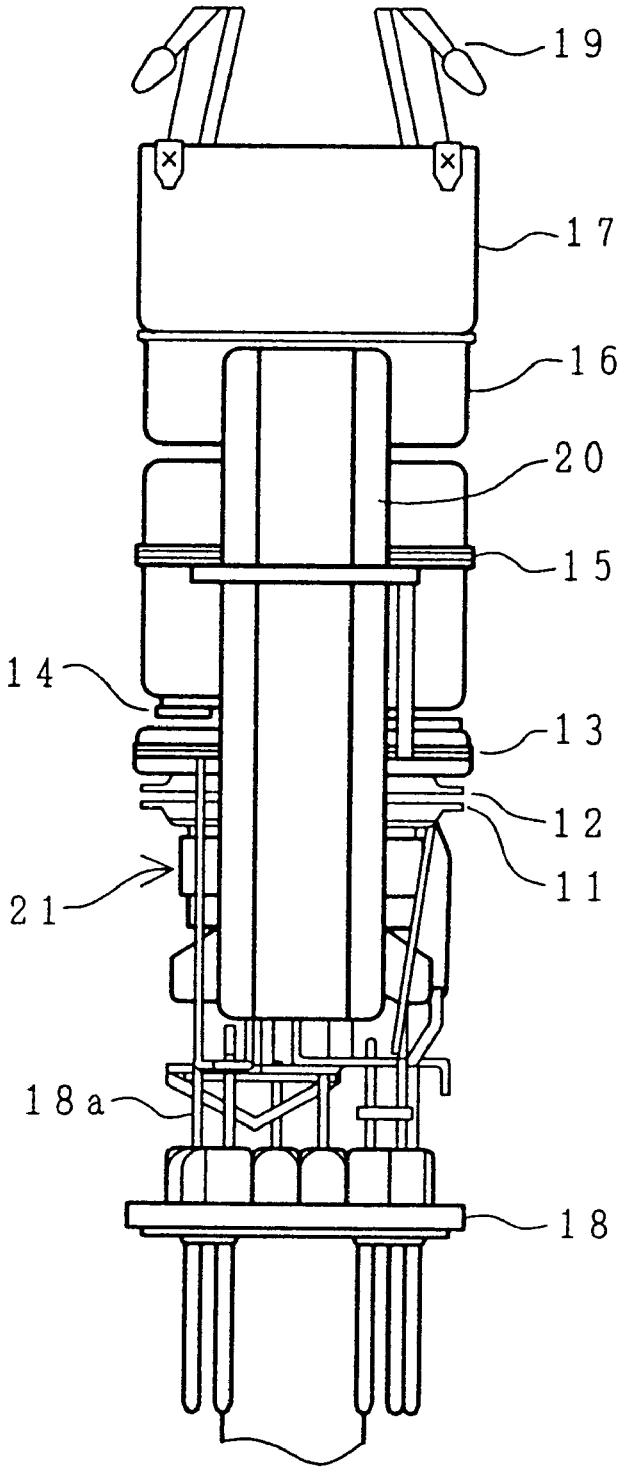
FIG. 6 (PRIOR ART)
FIG. 6 is a side elevation view of an electron gun for explaining an example of a structure of an electron gun used for the color cathode ray tube shown in FIG. 5.
Figure 7:
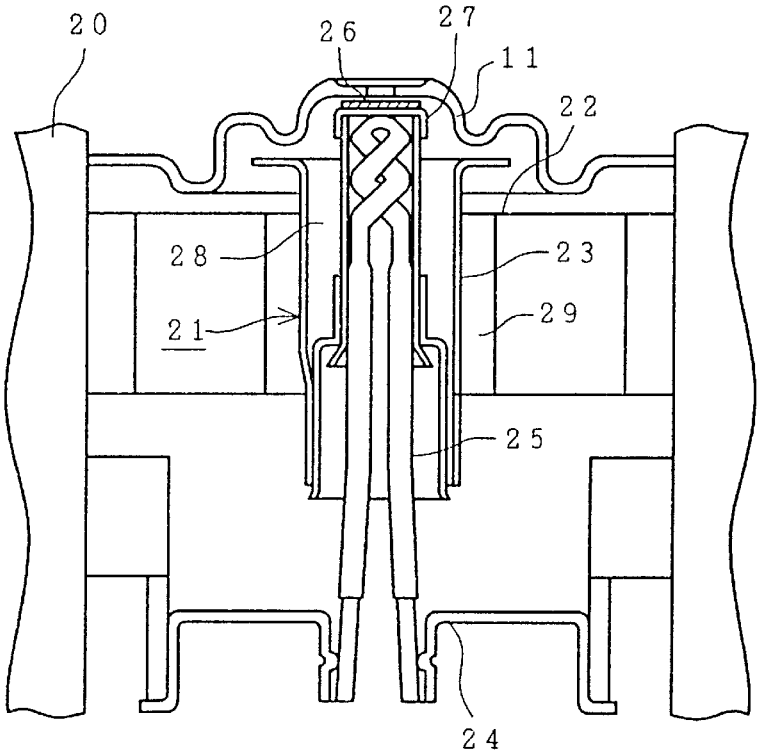
FIG. 7 (PRIOR ART)
FIG. 7 is a cross-sectional view of the indirectly heated cathode structure shown in FIG. 6.

Next, as illustrated in FIG. 4I, the tungsten wire 31 is wound spirally forward at the winding pitch of 150 turns per cm for the major heating portion HM from point H to point G, and then is wound spirally at the winding pitch of 30 turns per cm from point G to point E, and then is wound spirally at the winding pitch of 150 turns per cm from point E to point I which corresponds to a starting point of a three-layer winding portion TPW of a heater leg portion HL of a heater to be fabricated following and continuously with the heater under consideration) as indicated by an arrow X, forming a five-layer winding portion QWB ranging from point G to point H. Incidentally, a three-layer winding portion TWB has already been formed between point F and point H in the winding operation in connection with FIG. 4G.

The tungsten wire 31 thus wound around the molybdenum mandrel wire 40 is cut at the respective centers J, K of the five-layer winding portions QWA, QWB to provide a tungsten wire winding having a length HQL for one heater with the leg portions QHLA, QHLB of five-layer winding and is formed into a double helical shape after folding at the centerline CL as shown in FIG. 1. Then, after the heater is coated with alumina and then is fired, the molybdenum mandrel wire 40 is dissolved with acid to provide the completed heater 25. Reference characters TWA, TWB denote portions of three-layer winding.

In the five-layer winding structure of the above embodiment, the winding pitch of the first winding layer nearest the molybdenum mandrel wire 40 is 30 turns per cm, that of the second winding layer is 50 turns per cm, that of the third and fourth winding layers is 30 turns per cm and that of the five winding layer is 150 turns per cm.

Figure 10:
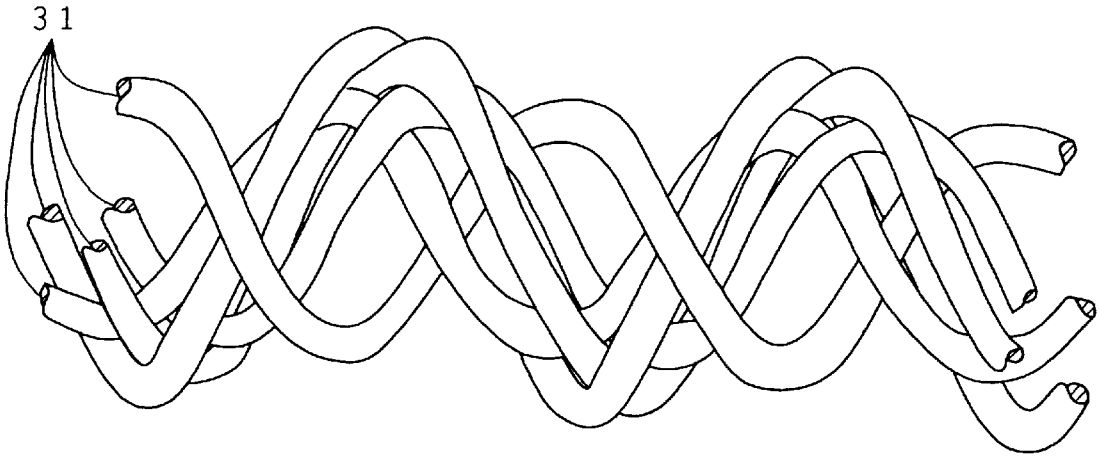
FIG. 10 is an enlarged fragmentary side view of the five-layer winding portion QUW of the leg portion of the heater of FIG. 1 with all of the layers wound at the same winding pitch.
Figure 11:
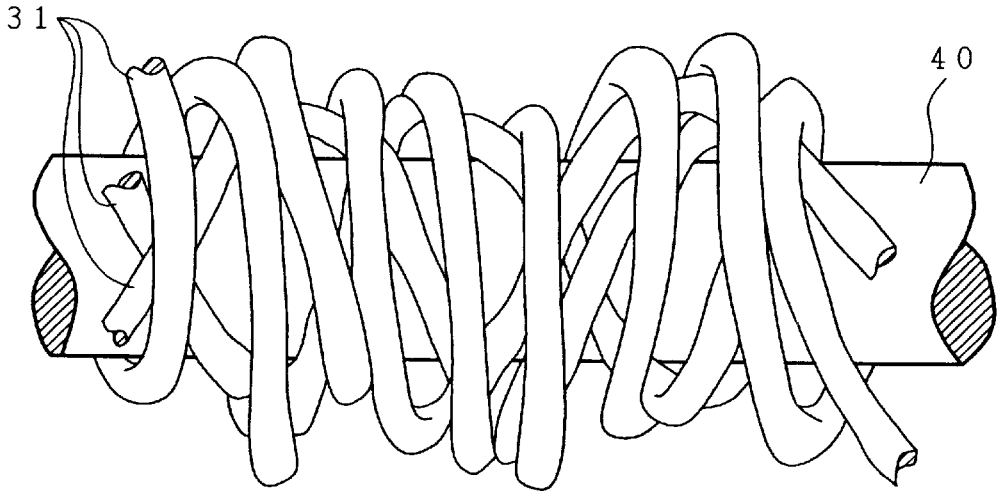
FIG. 11 is an enlarged fragmentary side view of the five-layer winding portion QUW of the leg portion of the heater of FIG. 1 with the layers wound at three different winding pitches.

A plurality of different winding pitches are employed to prevent the bunching of the wound tungsten wire. If all of the five winding layers are wound at the same pith, 30 turns per cm, for example, the wound tungsten wire groups in bunches and the degree of undulation of the envelope of the five-layer winding portion is greatly increased as shown in FIG. 10, and deteriorates the workability in the operation of welding heaters. In the above embodiment, the winding pitch of the second winding layer is made different from that of the first, third and fourth winding layers to reduce the degree of the undulation of the envelope of the five-layer winding portion as shown in FIG. 11.

The five-layer winding portions QWA, QWB are cut at points J, K as explained in connection with FIG. 4I. If the winding pitch of the outermost winding layer (the fifth layer) is coarse, the ends of the tungsten wires produced by cutting of the five-layer winding portion get easily frayed, and there is possibility that the frayed ends of the tungsten wires emit electrons toward the inner surface of the neck portion of the cathode ray tube.

Therefore in the above embodiment, the outermost winding layer is wound at a fine winding pitch of 150 turns per cm to prevent the cut ends of the tungsten wires from getting frayed. It is preferable that, in portions not covered with alumina, the coarsest winding pitch is in a range of 20 to 50 turns per cm and the finest winding pitch is in a range of 100 to 180 turns per cm. If the winding pitch is coarser than 20 turns per cm, the number of the winding layers needs to be increased, resulting in degradation of mass productivity, and if the winding pitch is finer than 180 turns per cm, this pitch needs to be made different from that of the major heating portion HM for heating a cathode and makes it difficult to set a winding machine.

By further winding the tungsten wires spirally around the above five-layer portions, the heaters having the seven- or nine-layer winding structure can be obtained. Also, by further winding the tungsten wires spirally around the above three-layer winding portions to obtain the five- or more-layer winding structure, the winding structure having a larger number of layers such as seven or nine layers can be employed instead of the above five-layer winding portions for welding.

As explained above, the present invention provides a cathode ray tube having improved workability in welding of heaters, enabling automated welding of the heaters, free from cracks in the alumina insulating layer of the heaters and superior in reliability, by increasing the number of winding layers of tungsten wires of the heaters in the portions to be welded to heater supports, for use in a cathode structure of an electron gun of the cathode ray tube to increase their rigidity of the welded portions.

What is claimed is:

1. A cathode ray tube comprising an evacuated envelope comprising a panel portion, a neck portion, a tunnel portion for connecting said panel portion and said neck portion and a stem having a plurality of pins therethrough and being sealed to close said neck portion at one end thereof, a phosphor screen formed on an inner surface of said panel portion, an electron gun housed in said neck portion, said electron gun comprising an electron beam generating section comprising an indirectly heated cathode structure, a control electrode and an accelerating electrode, and a main lens for focusing an electron beam from said electron beam generating section onto said phosphor screen, and a deflection yoke mounted around a vicinity of a transitional region between said neck portion and said funnel portion for scanning the electron beam on said phosphor screen, said indirectly heated cathode structure comprising a metal sleeve, a base metal having an electron emissive material coating on an outer top surface thereof and attached to one end of said metal sleeve, and a heater positioned within said metal sleeve, wherein said heater comprises a major heating portion having a spirally wound heating wire and leg portions disposed at ends of said major heating portion, each of said leg portions comprises a first multilayer winding portion having heating wires and a second multilayer winding portion disposed intermediate between said major heating portion and said first multilayer winding portion and having heating wires wound in a plurality of layers, said plurality of layers of said second multilayer winding portion being at least three layers, and said first multilayer winding portion being wound spirally in a plurality of layers greater in number than the at least three layers of said second multilayer winding portion, said major heating portion and at least a portion of said second multilayer winding portion are covered with an insulating coating, and said heater is welded to electrical conductors for applying a voltage thereto at said first multilayer winding portion.

2. A cathode ray tube according to claim 1, wherein the number of layers in said second multilayer winding portion is three and the number of layers of said first multilayer winding portion is five.

3. A cathode ray tube according to claim 1, wherein the number of layers in said second multilayer winding portion is odd and the number of layers of said first multilayer winding portion is odd.

4. A cathode ray tube according to claim 1, wherein said first multilayer winding portion comprises at least two kinds of winding layers spirally wound at pitches different from each other.

5. A cathode ray tube according to claim 4, wherein one of said at least two kinds of winding layers is spirally wound at a pitch in a range of 20 to 50 turns per cm, and another of said at least two kinds of winding layers is in a range of 100 to 180 turns per cm.

6. A cathode ray tube according to claim 5, wherein said another of said at least two kinds of winding layers is an outermost layer in said first multilayer winding portion.

7. A cathode ray tube according to claim 6, wherein said major heating portion is spirally wound at a same pitch as said another of said at least two kinds of winding layers.

* * * * *